US008575903B2

(12) United States Patent
Hua et al.

(10) Patent No.: US 8,575,903 B2
(45) Date of Patent: Nov. 5, 2013

(54) VOLTAGE REGULATOR THAT CAN OPERATE WITH OR WITHOUT AN EXTERNAL POWER TRANSISTOR

(75) Inventors: Jun Hua, Plano, TX (US); Gary L. Stirk, West Melbourne, FL (US)

(73) Assignee: Texas Instruments Incorporated, Dallas, TX (US)

( * ) Notice: Subject to any disclaimer, the term of this patent is extended or adjusted under 35 U.S.C. 154(b) by 359 days.

(21) Appl. No.: 12/977,821

(22) Filed: Dec. 23, 2010

(65) Prior Publication Data

US 2012/0161733 A1 Jun. 28, 2012

(51) Int. Cl.
*G05F 1/00* (2006.01)

(52) U.S. Cl.
USPC ..... 323/273

(58) Field of Classification Search
USPC ..... 323/268, 269, 273, 275
See application file for complete search history.

(56) References Cited

U.S. PATENT DOCUMENTS 5,182,526 A * 1/1993 Nelson ..... 323/280
6,975,099 B2 * 12/2005 Wu et al. ..... 323/280
7,710,091 B2 5/2010 Huang
2010/0026252 A1 2/2010 Lin et al.
2010/0213917 A1 * 8/2010 Pulijala et al. ..... 323/293

OTHER PUBLICATIONS

L5980, 0.7 A step-down switching regulator, Nov. 2009, pp. 1, 8, 30 and 34, Doc ID 13003 Rev 6, STMicroelectronics.
L7981, 3 A step-down switching regulator, Jul. 2010, pp. 1, 8, 31 and 35, Doc ID 15182 Rev 3, STMicroelectronics.
Steven M. Sandler, Low Dropout Regulator Stability Considerations, 2005, pp. 1-6, AEi Systems, LLC.
"LM100/LM200/LM300 voltage regulator," general description, pp. 1-1 through 1-3, Hua (see article below for proof of date).
"LM 100 National Semiconductor Corporation (NSC) integrated circuit," Research from Mar. 18, 1988 http://www.computerhistory.org/collections/accession/102709959 (pulled Jul. 9, 2013).

* cited by examiner

*Primary Examiner* — Jue Zhang
(74) *Attorney, Agent, or Firm* — William B. Kempler; W. James Brady III; Frederick J. Telecky, Jr.

(57) ABSTRACT

A voltage regulator, according to the present invention, can operate with or without an external power transistor to generate a regulated output voltage. The voltage regulator determines whether an external power transistor is connected thereto. The voltage regulator then automatically sets a frequency compensation scheme that depends on whether an external power transistor has been detected.

18 Claims, 7 Drawing Sheets

VOLTAGE REGULATOR THAT CAN OPERATE WITH OR WITHOUT AN EXTERNAL POWER TRANSISTOR

BACKGROUND OF THE INVENTION

Voltage regulators are commonly used in electronic devices to maintain a load current at a specified proper voltage level for powering the various electronic components of the device. In a typical low dropout voltage regulator, the load current is passed through a power transistor (a pass element) that is regulated by a feedback loop (a control circuit) that ensures the voltage level output by the power transistor is held relatively constant. The control circuitry that regulates the operation of the power transistor is typically contained in an integrated circuit (IC). The power transistor, however, may or may not also be contained in the integrated circuit along with the other circuitry.

FIGS. 1 and 2 illustrate the two general voltage regulator design types. FIG. 1 shows a voltage regulator 100 with an IC 102 having an internal power transistor 104, and FIG. 2 shows a voltage regulator 106 with an IC 108 connected to an external power transistor 110. In either case, the voltage regulator 100 or 106 supplies power at a regulated output voltage level to a load represented by a resistor 112 or 114 and a capacitor 116 or 118, respectively. Feedback loops (generally involving functions such as those of amplifiers 120 and 122, feedback voltage dividers 124 and 126 and reference voltage generators 128 and 130 interconnected as shown) that control or regulate the operation of the power transistors 104 and 110 are very similar to each other in concept. However, whereas the IC 102 has an input node 132 to provide the supply voltage to the internal power transistor 104 and an output node 134 for the output voltage from the internal power transistor 104; the IC 108 has an output node 136 for a control signal from the amplifier 122 to the external power transistor 110 and an input node 138 to provide feedback of the output voltage into the IC 108.

Sometimes, whether an electronic device maker uses an internal power transistor or an external power transistor may be simply a matter of design choice. However, the choice is often constrained by other design requirements. For instance, voltage regulators of the second design type (with the external power transistor 110) typically are better able to handle greater load current levels than are voltage regulators of the first design type (with the internal power transistor 104). Additionally, voltage regulators of the first design type are typically smaller than voltage regulators of the second design type. Other differences can also constrain the design choice. Therefore, the two design types are usually not interchangeable.

In either of the voltage regulator design types, some form of frequency compensation scheme must be implemented to ensure proper functioning of the voltage regulator (e.g. 100 or 106) and of the electronic components powered thereby. Due to the differences in device parameters of the internal and external power transistors (e.g. width/length ratio, threshold voltage, transconductance, gate capacitance, etc.), which can be different by several orders of magnitude, among other considerations, the potential frequency compensation schemes for one design type are generally incompatible with the other design type. Therefore, the designs for the different types of voltage regulators (e.g. 100 and 106), and the ICs (e.g. 102 and 108) used therein, must implement very different and non-interchangeable frequency compensation schemes.

As a consequence of the inherent differences between the two general voltage regulator types and the relative advantages and disadvantages of each, it is necessary for designers and manufacturers of the voltage regulator ICs (e.g. 102 and 108) to produce at least two different voltage regulator ICs (or families of voltage regulator ICs), so they can satisfy their customers' needs for either type of voltage regulator circuitry, since the same voltage regulator IC cannot be used in both types of applications, even though either design type could conceivably be used in some of the same electronic devices. In other words, the designers and manufacturers of the voltage regulator ICs must maintain availability of at least two SKUs (stock keeping units) for multiple products that are somewhat redundant in spite of being of incompatible and non-interchangeable designs. As is usually the case, however, larger numbers of SKUs generally lead to lower efficiencies in resource utilization and inventory management and, thus, higher costs for each SKU.

SUMMARY OF THE INVENTION

According to various method and apparatus embodiments of the present invention, a voltage regulator IC has an internal power transistor, but can also operate in applications that include an external power transistor. The IC determines in which type of application it is, preferably almost immediately upon power-up, by detecting whether the external power transistor is connected thereto. In response, the IC then automatically configures an internal frequency compensation scheme that depends on whether the external power transistor is present.

According to more specific embodiments, the IC monitors two I/O nodes, pins or ports, rather than having to rely on some kind of programming or external intervention, to determine whether the external power transistor is connected to the IC. At one of the I/O nodes, the IC receives a supply voltage in both configurations (i.e. with or without the external power transistor). At the other I/O node, the IC receives the supply voltage when there is no external power transistor, but uses this node to control the external power transistor when it is present. There is, thus, a significant voltage drop (e.g. due to the Vgs of the external power transistor) between these two I/O nodes when the external power transistor is present, but no such voltage drop in the absence of the external power transistor. The IC, therefore, can determine in which type of application it is by comparing the voltages at these two I/O nodes.

According to other more specific embodiments, when the IC detects the presence of the external power transistor, the IC preferably turns on a switch which causes a capacitor to be included in the regulation feedback loop, thereby automatically configuring the frequency compensation scheme to include the capacitor in the loop. On the other hand, when the IC detects the absence of the external power transistor, the IC preferably turns off the switch, which causes the capacitor not to be included in the regulation feedback loop, thereby automatically configuring the frequency compensation scheme not to include the capacitor in the loop.

A more complete appreciation of the present disclosure and its scope, and the manner in which it achieves the above noted improvements, can be obtained by reference to the following detailed description of presently preferred embodiments taken in connection with the accompanying drawings, which are briefly summarized below, and the appended claims.

DETAILED DESCRIPTION OF THE INVENTION

Figure 3:
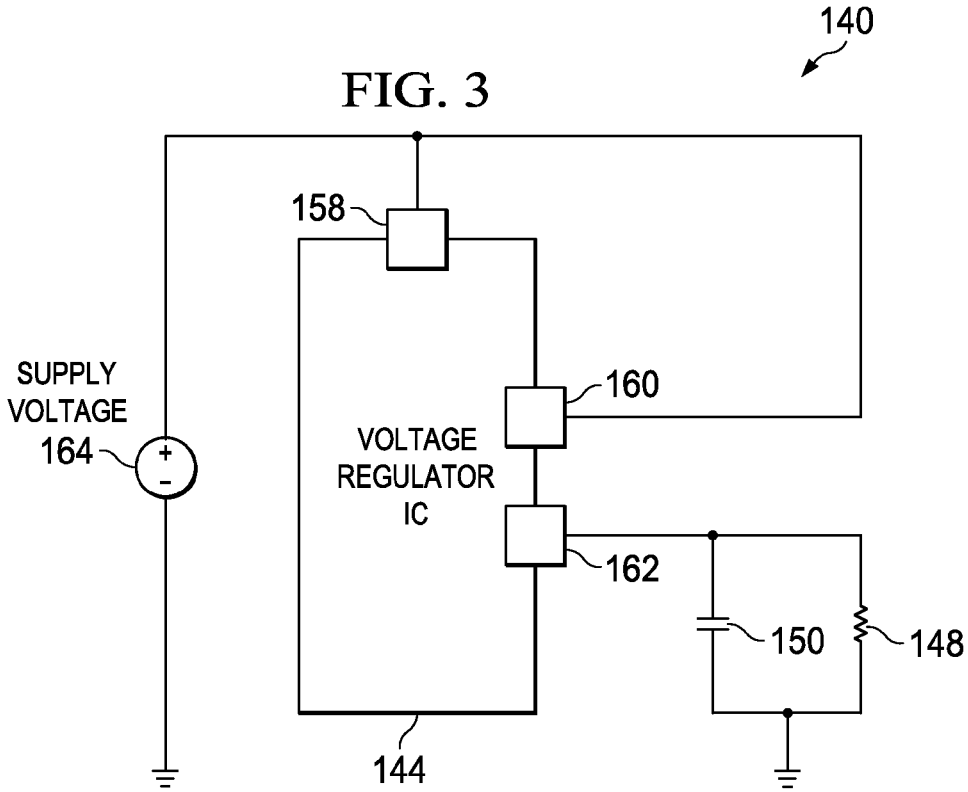
FIG. 3 is a simplified schematic diagram of a voltage regulator in a configuration without an external power transistor, according to an embodiment of the present invention.
Figure 4:
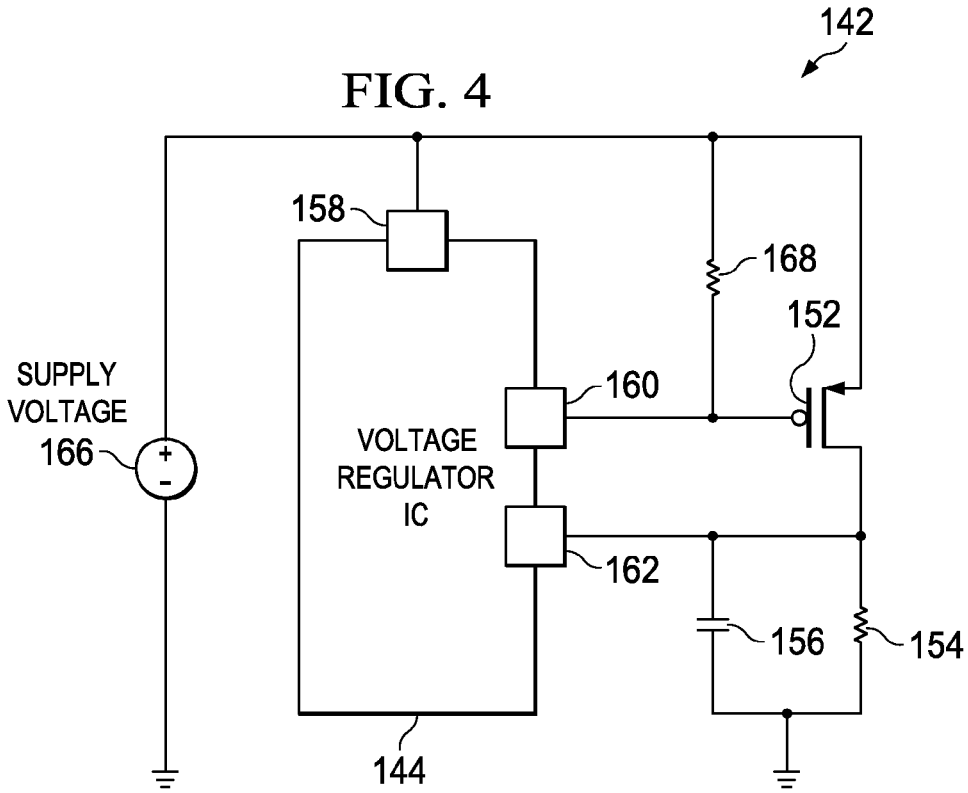
FIG. 4 is a simplified schematic diagram of a voltage regulator in a configuration with an external power transistor, according to an embodiment of the present invention.

Voltage regulators 140 and 142 are shown in FIGS. 3 and 4 as having the same voltage regulator IC 144. In FIG. 3 (a first configuration), the voltage regulator IC 144 is not connected to an external bypass power transistor, but relies on an internal bypass power transistor (e.g. 146 in FIG. 5) to provide power at a regulated voltage level to a relatively small load, represented by a load resistor 148 and a load capacitor 150 (which may include a decoupling capacitor from the output voltage to ground as specified by the designer or manufacturer of the voltage regulator IC 144). In FIG. 4 (a second configuration), on the other hand, the voltage regulator IC 144 is connected to an external bypass power transistor 152, which the voltage regulator IC 144 controls to provide power at a regulated voltage level to a relatively large load represented by a load resistor 154 and a load capacitor 156 (again, which may also include a specified decoupling capacitor). Thus, the voltage regulator IC 144, as described below, can be used in either of the two general voltage regulator design types in spite of their inherent differences. Therefore, the designer and manufacturer of the voltage regulator IC 144 has to produce only one voltage regulator IC (or one family of voltage regulator ICs) in order to satisfy a customer's needs for either type of voltage regulator circuitry. In other words, the designer and manufacturer of the voltage regulator IC 144 can maintain availability of as few as only one SKU (stock keeping unit) that, nevertheless, can be used in otherwise incompatible and non-interchangeable designs. Additionally, as is usually the case, the lower number of SKUs generally leads to greater efficiencies in resource utilization and inventory management and, thus, lower costs for each SKU.

Figure 5:
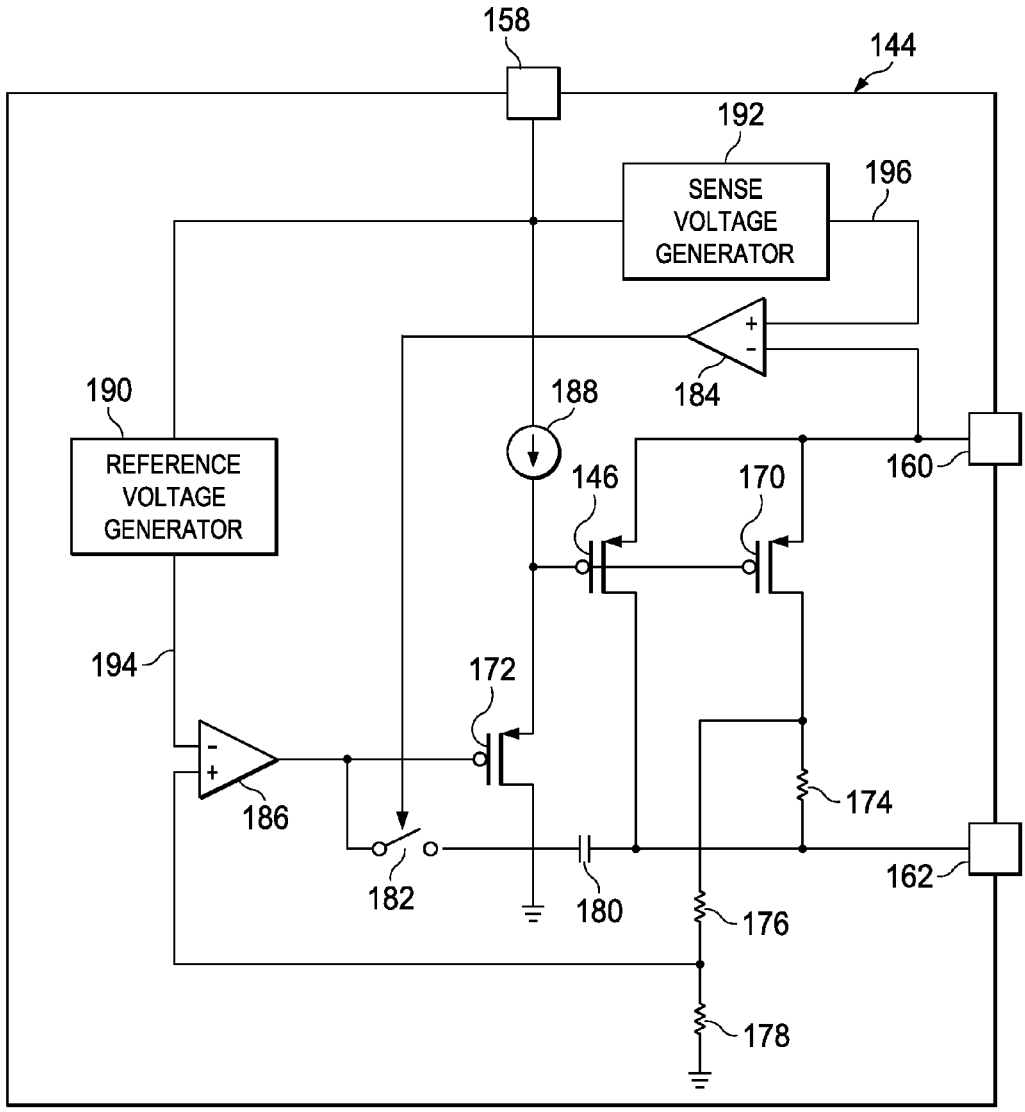
FIG. 5 is a simplified schematic diagram of a voltage regulator IC for use in the voltage regulators shown in FIGS. 3 and 4, according to an embodiment of the present invention.

The internal and external power transistors 146 and 152 are shown as P-channel MOSFETs. However, it is understood that the present invention is not necessarily so limited, but can be adapted for use with N-channel MOSFETs, as well as with BJTs, with appropriate modifications. Additionally, the circuitry in FIGS. 3, 4 and 5 is of a general type known as a "low dropout regulator." Again, it is understood that the present invention is not necessarily so limited, but can be adapted for use with other types of devices or circuitry.

In FIGS. 3 and 4, the voltage regulator IC 144 is shown having three I/O nodes, pins or ports 158, 160 and 162. The voltage regulator IC 144 may also have other I/O nodes, not shown, for other functions/features not described herein. It is further preferable, for cost reduction purposes, that neither a dedicated configuration pin/node nor any type of programming means is used in order to implement the features described herein. Instead, the voltage regulator IC 144 automatically detects the physical configuration in which it has been placed and, in response, dynamically activates or deactivates circuitry within itself that is appropriate for the detected configuration.

In the configuration of FIG. 3, the voltage regulator IC 144 receives a supply voltage 164 at the first and second I/O nodes 158 and 160. In some embodiments, the first and second I/O nodes 158 and 160 are simply shorted together externally, e.g. by a wire, or trace, on a printed circuit board on which the voltage regulator IC 144 is mounted, so these two nodes have almost no voltage difference between them. (The supply voltage 164 may, for example, come from a battery, a power adapter or other suitable voltage source.) Additionally, the voltage regulator IC 144 produces the output voltage for the load 148/150 at the third I/O node 162, as described below. In the first configuration, therefore, the voltage regulator IC 144 passes a current (at a first output current level) from the second I/O node 160 (through the internal power transistor 146, as described below) out through the third I/O node 162 to the load 148/150. Additionally, the voltage regulator IC 144 regulates the output voltage (as described below) at the third I/O node 162 to a desired voltage level for proper functioning of the load 148/150.

In the configuration of FIG. 4, the voltage regulator IC 144 receives a supply voltage 166 and is connected to the source of the external power transistor 152 at the first I/O node 158. (The supply voltage 166 may, for example, come from a battery, a power adapter or other suitable voltage source.) Additionally, the gate of the external power transistor 152 is connected to the second I/O node 160, and the drain of the external power transistor 152 is connected to the third I/O node 162 (as well as to the load 154/156). Also, a resistor 168 is connected between the source and gate of the external power transistor 152 (i.e. the first and second I/O nodes 158 and 160).

In the configuration of FIG. 4, the second I/O node 160 serves as a control node for controlling the operation of, or the driving of, the external power transistor 152 as it passes a current (at a second output current level) from the supply voltage 166 to the load 154/156. The resistor 168 ensures that if the control voltage at the second I/O node 160 is "floating," then the gate voltage of the external power transistor 152 will be pulled up to the supply voltage 166, thereby shutting off the external power transistor 152.

In the configuration of FIG. 4, the third I/O node 162 serves as a feedback input node for regulating the voltage level of the output voltage provided at the drain of the external power transistor 152 to the load 154/156. The voltage regulator IC 144, thus, can control the voltage at the second I/O node 160 in response to the feedback, thereby regulating the voltage output by the external power transistor 152.

In other words, the second and third I/O nodes 160 and 162 have different functions, depending on whether the voltage regulator IC 144 is in the first or second configuration. Specifically, in the first configuration, the second I/O node 160 is an input node (for the supply voltage), and the third I/O node 162 is an output node (for the output voltage). On the other hand, in the second configuration, the second I/O node 160 is an output node (for a control, or gate drive, signal), and the third I/O node 162 is an input node (for a regulation feedback signal).

Figure 1:
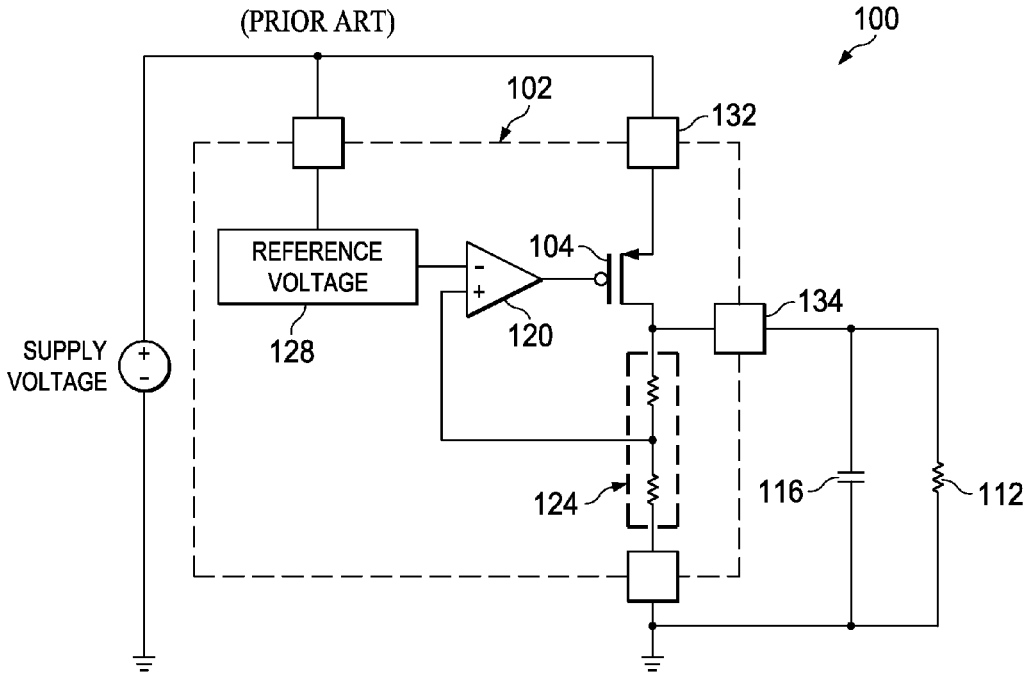
FIG. 1 (PRIOR ART)
FIG. 1 is a simplified schematic diagram of a prior art voltage regulator incorporating an internal power transistor.
Figure 2:
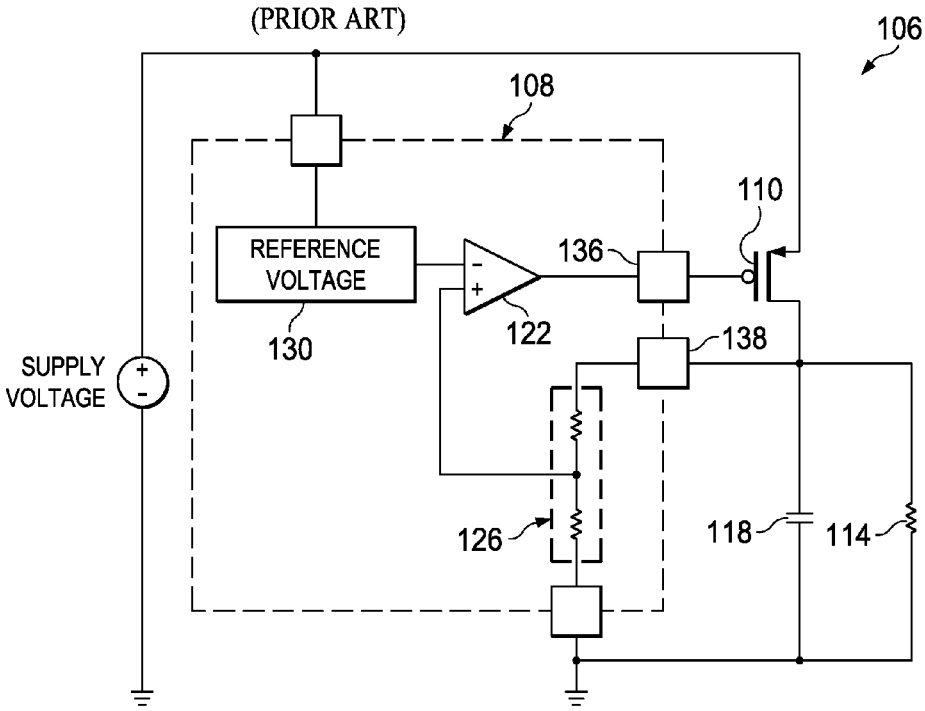
FIG. 2 (PRIOR ART)
FIG. 2 is a simplified schematic diagram of a prior art voltage regulator incorporating an external power transistor.

Additionally, the current that can thus be provided to the load 154/156 in the second configuration is typically substantially greater than the current that can be provided to the load 148/150 in the first configuration of FIG. 3. Therefore, the voltage regulator IC 144 can be used in situations that include a much broader range of load currents than can either of the prior art circuits of FIG. 1 or 2.

The voltage regulator IC 144, in the illustrated embodiment shown in FIG. 5, generally includes the internal power transistor 146, transistors 170 and 172, resistors 174, 176 and 178, an internal capacitor 180, an internal switch 182, a comparator 184, an amplifier 186, a current source 188, a reference voltage generator 190 and a sense voltage generator 192. It is understood, however, that the present invention is not necessarily limited to embodiments that include this exact set of components in the arrangement shown, but preferably includes other embodiments having other sets of components that perform functions or provide features similar to those described herein.

In the first configuration (FIG. 3) using the illustrated embodiment of the voltage regulator IC 144, the main current path (from the power source to the load) is from the supply voltage 164 to the second I/O node 160 through the internal power transistor 146 to the third I/O node 162 and then to the load 148/150. A small portion of the current from the second I/O node 160 to the third I/O node 162 passes through the transistor 170 and the resistor 174 (to sense the current level) in parallel to the current that passes through the internal power transistor 146. However, the transistor 170 is preferably sized (e.g. about two hundredths of the size of the internal power transistor 146) so the current through it is relatively small, e.g. about 1% of the total load current, so it does not appreciably affect the total load current.

The internal power transistor 146 and the sense transistor 170 are driven by the transistor 172. The transistor 172 is preferably a source follower with low output impedance. The source follower transistor 172 may be considered part of the amplifier 186 and, with the current source 188, drives the internal power transistor 146 and the sense transistor 170 according to the control function of the amplifier 186.

The amplifier 186 receives a reference voltage (on line 194) from the reference voltage generator 190 at a negative input and a feedback voltage from a voltage divider (i.e. the resistors 176 and 178) at a positive input. The output of the amplifier 186 controls the source follower transistor 172 and, thus, the internal power transistor 146 and the sense transistor 170. Under this control, the internal power transistor 146 produces the output voltage at the third I/O node 162. The output voltage, through the sense resistor 174 and the voltage divider 176/178, forms the feedback voltage that completes a feedback loop at the positive input of the amplifier 186. This feedback loop generally regulates the output voltage at the third I/O node 162 to a desired voltage level, or to within a specified load regulation range.

The sense voltage generator 192 preferably subtracts an appropriate amount (e.g. about 100 millivolts) from the supply voltage 164 or 166 (received, e.g., at the first I/O node 158) to establish a sense voltage (on line 196) that is provided to a positive input of the comparator 184. In the first configuration (FIG. 3), since the first and second I/O nodes 158 and 160 are shorted together, the comparator 184 receives the supply voltage 164 at a negative input thereof. In this case, therefore, the comparator 184 produces a first appropriate voltage level (e.g. a low voltage), since the supply voltage 164 is greater than the sense voltage on line 196. The low voltage output from the comparator 184 turns off, or opens, the switch 182. Since the switch 182 is open, the capacitor 180 (connected between the switch 182 and the third I/O node 162) does not affect the circuitry (i.e. does not contribute to frequency compensation) when the voltage regulator IC 144 is in the first configuration (FIG. 3).

In the first configuration (FIG. 3), therefore, the frequency compensation is realized by the interaction of the current sensing transistor 170, the resistor 174 and the load capacitor 150 (FIG. 3). The transistor 170 and the resistor 174 sense the current and with the load capacitor 150 create a frequency "zero". The frequency zero offsets a frequency "pole" at the gate of the transistor 172, thereby boosting the phase margin of the circuit, as described below. The dominant pole of the circuitry in this configuration is set by the load capacitor 150 and the output impedance at the third I/O node 162. Additionally, a pole at the gate of the internal power transistor 146 (which is relatively large and has significant gate capacitance) is moved to high frequency due to the low output impedance of the source follower transistor 172.

In the second configuration (FIG. 4) using the illustrated embodiment of the voltage regulator IC 144 in FIG. 5, the source and gate of the external power transistor 152 are connected to (and the external pull-up resistor 168 is connected between) the first and second I/O nodes 158 and 160, respectively. Therefore, the main current path is from the supply voltage 166 through the external power transistor 152 to the load 154/156. The internal power transistor 146, however, forms a "compound output stage" with the external power transistor 152 (and the external pull-up resistor 168) to contribute to producing the overall load current. The pull-up resistor 168 preferably has an appropriate resistance value (e.g. between a few hundred KΩ and about 1 MΩ) such that the bias current of the internal power transistor 146 is typically a few micro amperes. As a result, the affect of the current sense transistor 170 and resistor 174 in the second configuration is even less than it is in the first configuration.

The output voltage at the drain of the external power transistor 152 is fed back at the third I/O node 162 through the sense resistor 174 and the voltage divider 176/178 to form the feedback voltage supplied to the positive input of the amplifier 186. With the feedback voltage and the reference voltage on the line 194, the amplifier 186 controls the source follower transistor 172 and, thus, the internal power transistor 146 and the sense transistor 170. However, in this configuration, the presence of the external power transistor 152 and the external pull-up resistor 168 results in the feedback control loop causing the internal power transistor 146 (and the sense transistor 170) to maintain the gate voltage of the external power transistor 152 to be less than the supply voltage 166 by about the gate-source voltage drop (Vgs) threshold required to operate the external power transistor 152. By thus maintaining the gate voltage of the external power transistor 152 relative to the supply voltage 166, the feedback control loop can automatically adjust the load current through the external power transistor 152 and regulate the output voltage over a broad range of the supply voltage 166.

A gate-source voltage drop (Vgs) of about one Volt (or greater), for example, is common. Such a Vgs results in the gate voltage, i.e. the voltage at the second I/O node 160, which is the voltage supplied to the negative input of the comparator 184, being substantially less than the sense voltage on line 196, which is preferably the supply voltage 166 minus an appropriate amount, e.g. about 100 millivolts. In this case, therefore, the comparator 184 produces a second appropriate voltage level (e.g. a high voltage), which turns on, or closes, the switch 182. (The comparator 184 is, thus, an internal sensor that determines whether the external power transistor 152 is connected to the voltage regulator IC 144.) Since the switch 182 is closed when the voltage regulator IC 144 is in the second configuration (FIG. 4), the capacitor 180 is connected between the gate of the source follower transistor 172 and the output voltage at the third I/O node 162.

When the capacitor 180 is connected in this manner, it forms a standard "Miller compensation network" with the high gain of the external power transistor 152 and splits the dominant and non-dominant poles of the feedback control loop on opposite sides of the capacitor 180. The gate of the source follower transistor 172, thus, becomes the dominant pole of the feedback control loop in this configuration. The low output impedance of the source follower transistor 172 ensures that the pole at the gate of the internal power transistor 146 is moved to high frequency. Additionally, in this configuration, there is insufficient current through the sense transistor 170 to cause a zero by the sense resistor 174 and the load capacitor 156, as was the case in the first configuration (FIG. 3). Instead, the non-dominant pole at the third I/O node 162 is pushed to a high frequency.

When the voltage regulator IC 144 starts up, the voltage at the second I/O node 160 drops as the feedback control loop drives it down. Once the voltage at the second I/O node 160 is lower than the sense voltage on line 196, the comparator 184 outputs the appropriate voltage level (e.g. the high voltage) that turns on the switch 182 and connects the capacitor 180 into the feedback control loop. Additionally, the comparator 184 is preferably a voltage comparator, or other appropriate device which operates relatively fast, e.g. compared to the amplifier 186. Therefore, before the feedback control loop settles following startup, the comparator 184 will have determined its output (e.g. high or low), and the switch 182 will have been turned on or off accordingly. In other words, the frequency compensation scheme (with or without the Miller compensation capacitor 180) will be ready before the feedback control loop is in regulation. Thus, the operation of the comparator 184, the switch 182 and the Miller compensation capacitor 180 does not affect the stability of the circuit. Furthermore, during operation, even when a large load step is encountered, the detection thereof is fast enough for the frequency compensation scheme to remain reliable.

In other words, by detecting the voltage drop across two existing pins (the first and second I/O nodes 158 and 160), the voltage regulator IC 144 dynamically configures (and reliably maintains the configuration of) the frequency compensation scheme that is required for the feedback control loop and does not require additional external compensation to use the external power transistor 152. Therefore, the voltage regulator IC 144 can be used in both types of voltage regulator circuitry without the need for an additional dedicated configuration pin/node or any type of programming means. As a result, even though the voltage regulator IC 144 is more complex than either of the ICs 102 or 108 of FIGS. 1 and 2, the voltage regulator IC 144 enables a designer or manufacturer to produce a single chip, so the number of SKUs can be reduced and the economy-of-scale and manufacturing benefits can be realized.

Figure 6:
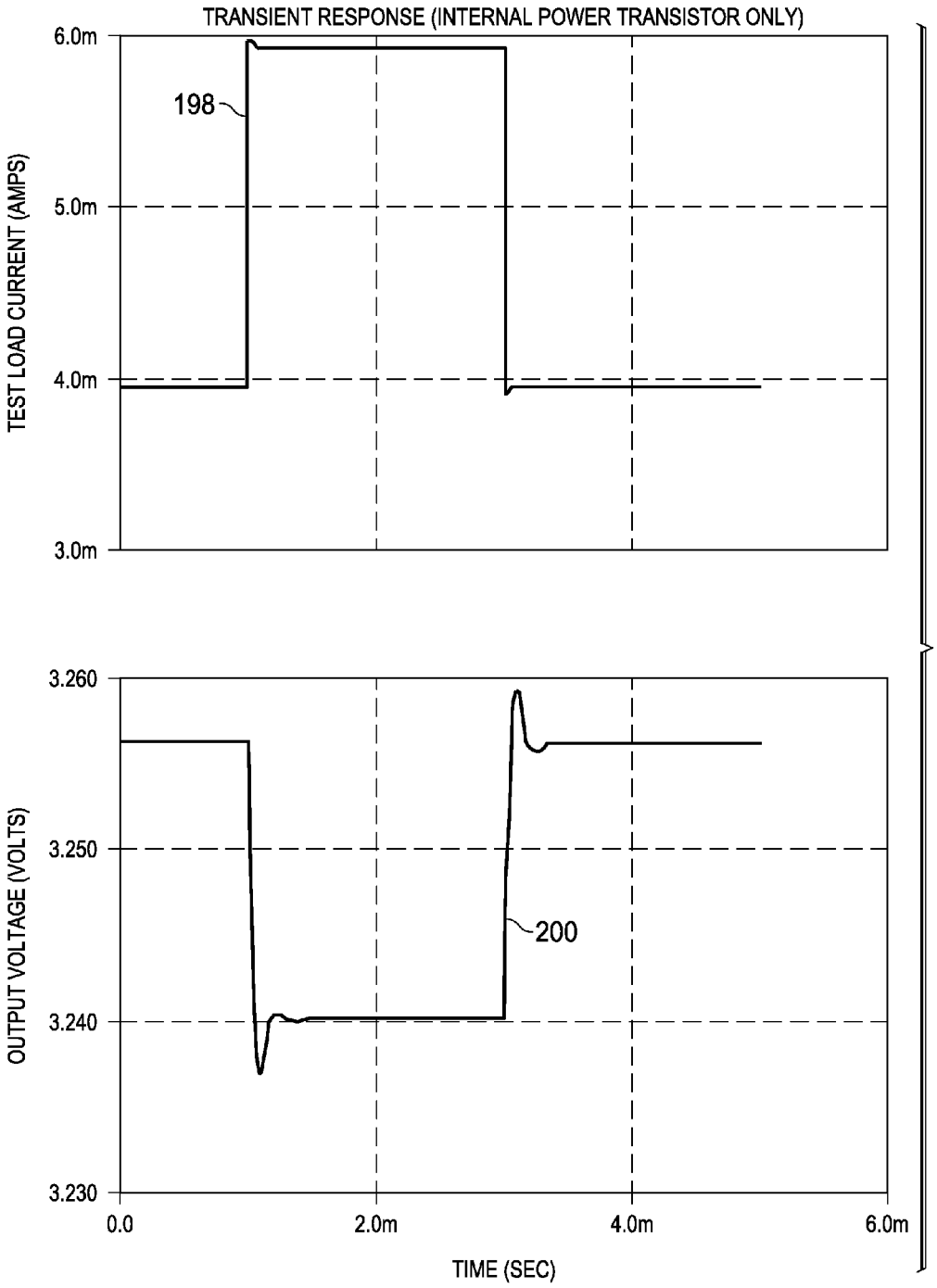
FIG. 6 includes example graphs illustrating a transient response of the voltage regulator in the configuration shown in FIG. 3, according to an embodiment of the present invention.
Figure 7:
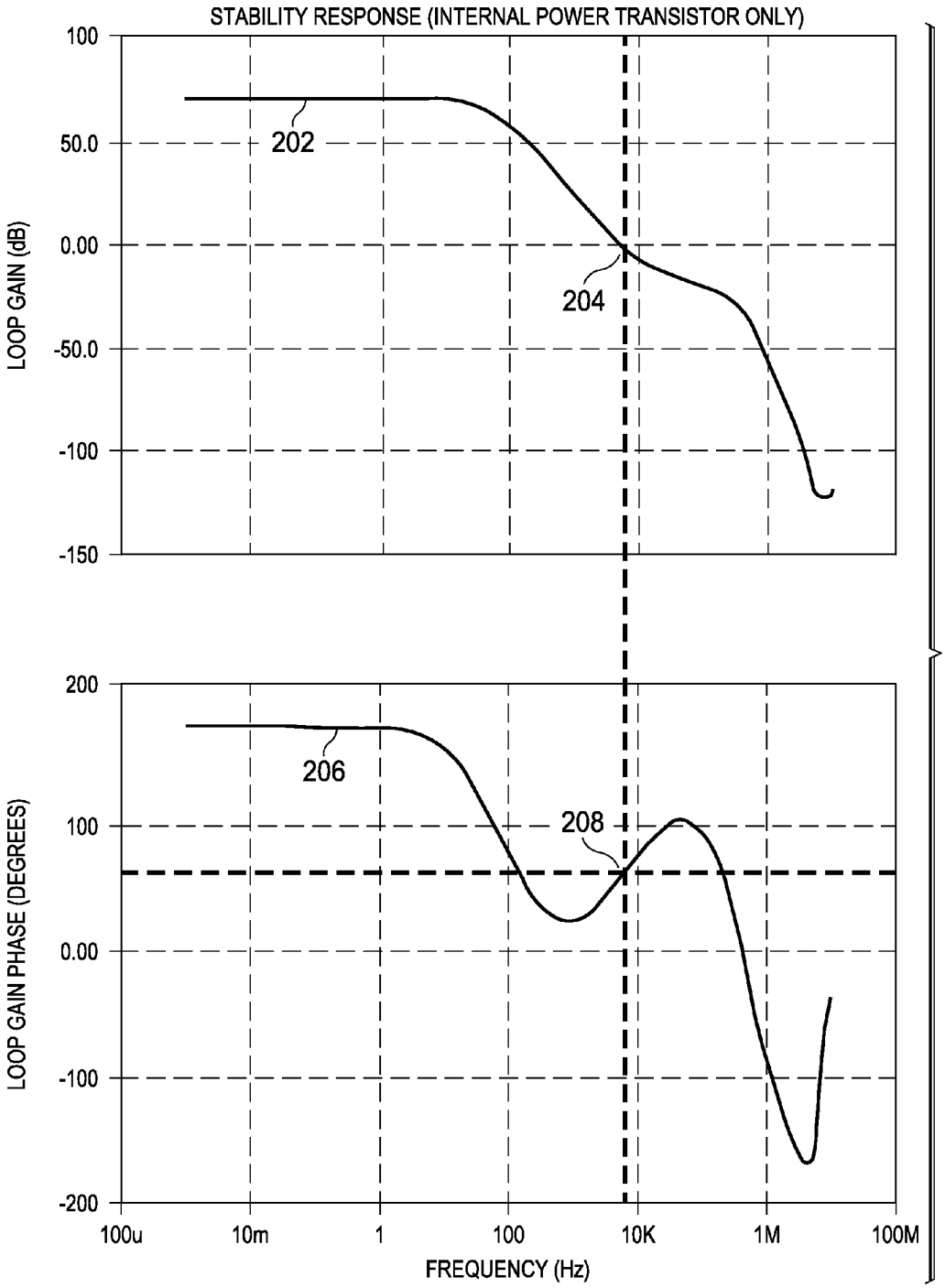
FIG. 7 includes example graphs illustrating a stability response of the voltage regulator in the configuration shown in FIG. 3, according to an embodiment of the present invention.

FIG. 6 shows a transient step response and FIG. 7 shows a Bode plot for a simulated operation of an example implementation of the voltage regulator IC 144 (FIG. 5) in the configuration with only the internal power transistor 146 (FIG. 3). A test load current with a load step from about 4 mA to about 6 mA, about a 50% increase, and back with a one microsecond rise/fall time (upper graph 198 of FIG. 6) is used to exercise the circuitry in the simulation. The output voltage response (lower graph 200 of FIG. 6) shows that at about the 4 mA load the output voltage is about 3.256 Volts, and at about the 6 mA load the output voltage is about 3.240 Volts. At the transitions, the output voltage transient step response exhibits minor ringing, with one overshoot and one (relatively small) undershoot, before quickly settling. The load regulation is approximately 12.4 mV/mA, which is caused by the compensation resistor 174.

A loop gain graph 202 (upper portion of FIG. 7) for the simulation shows that unity gain (at point 204) for the voltage regulator IC 144 in this example occurs at a frequency of about 6.14 KHz (vertical dashed line). A loop gain phase graph 206 (lower portion of FIG. 7) for the simulation shows that the frequency of 6.14 KHz (unity gain) corresponds (at point 208) with a phase margin of about 63.3 degrees (horizontal dashed line) for the example voltage regulator 144.

A phase margin of more than 45 degrees generally assures that a circuit is stable, and a transient step response having less than three significant rings before settling is generally desirable. The phase margin of about 63.3 degrees is well situated within this limitation, so it is considered stable, which generally agrees with the output voltage transient step response of only two overshoots/undershoots before settling to a steady state.

Figure 8:
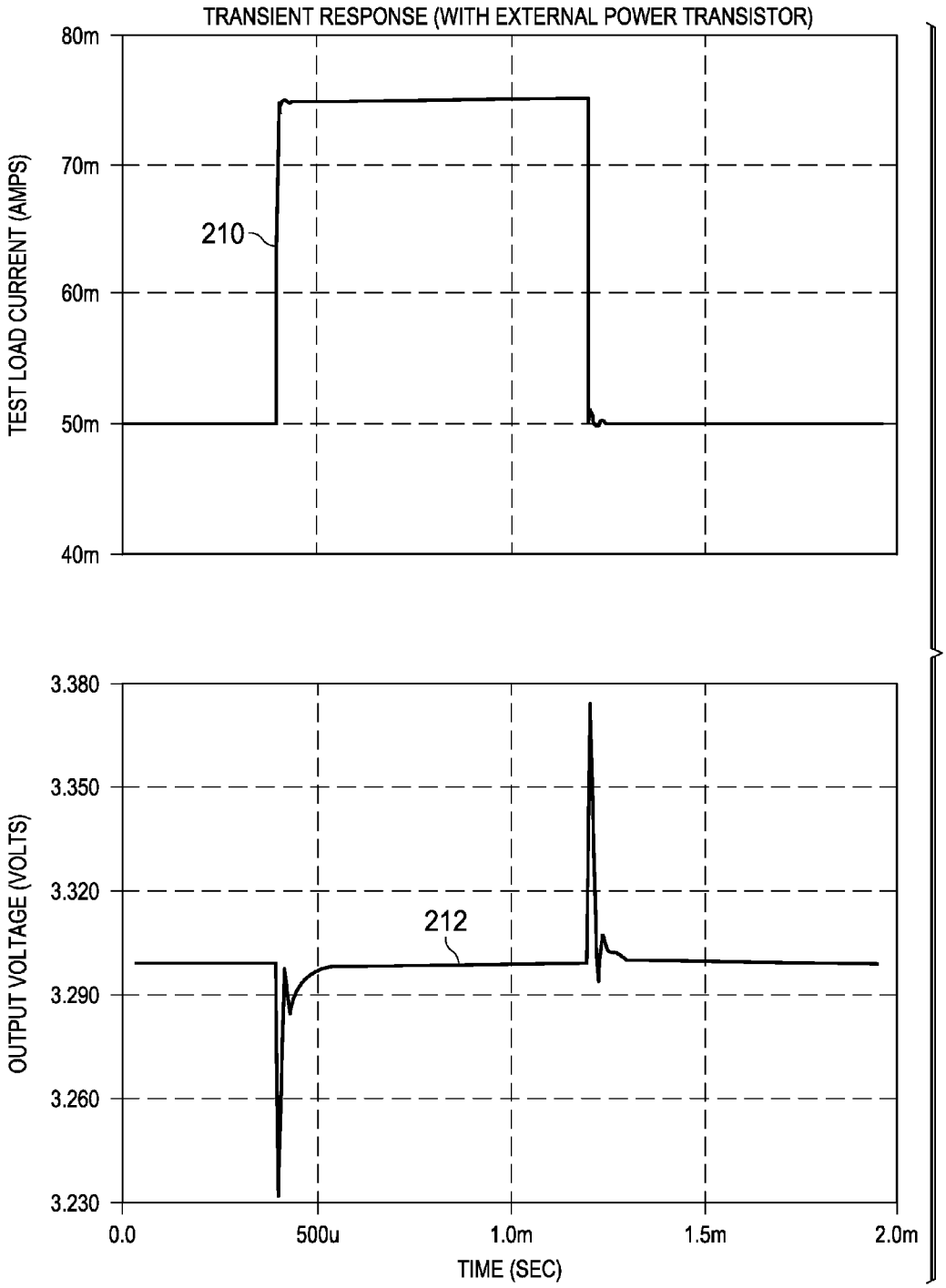
FIG. 8 includes example graphs illustrating a transient response of the voltage regulator in the configuration shown in FIG. 4, according to an embodiment of the present invention.
Figure 9:
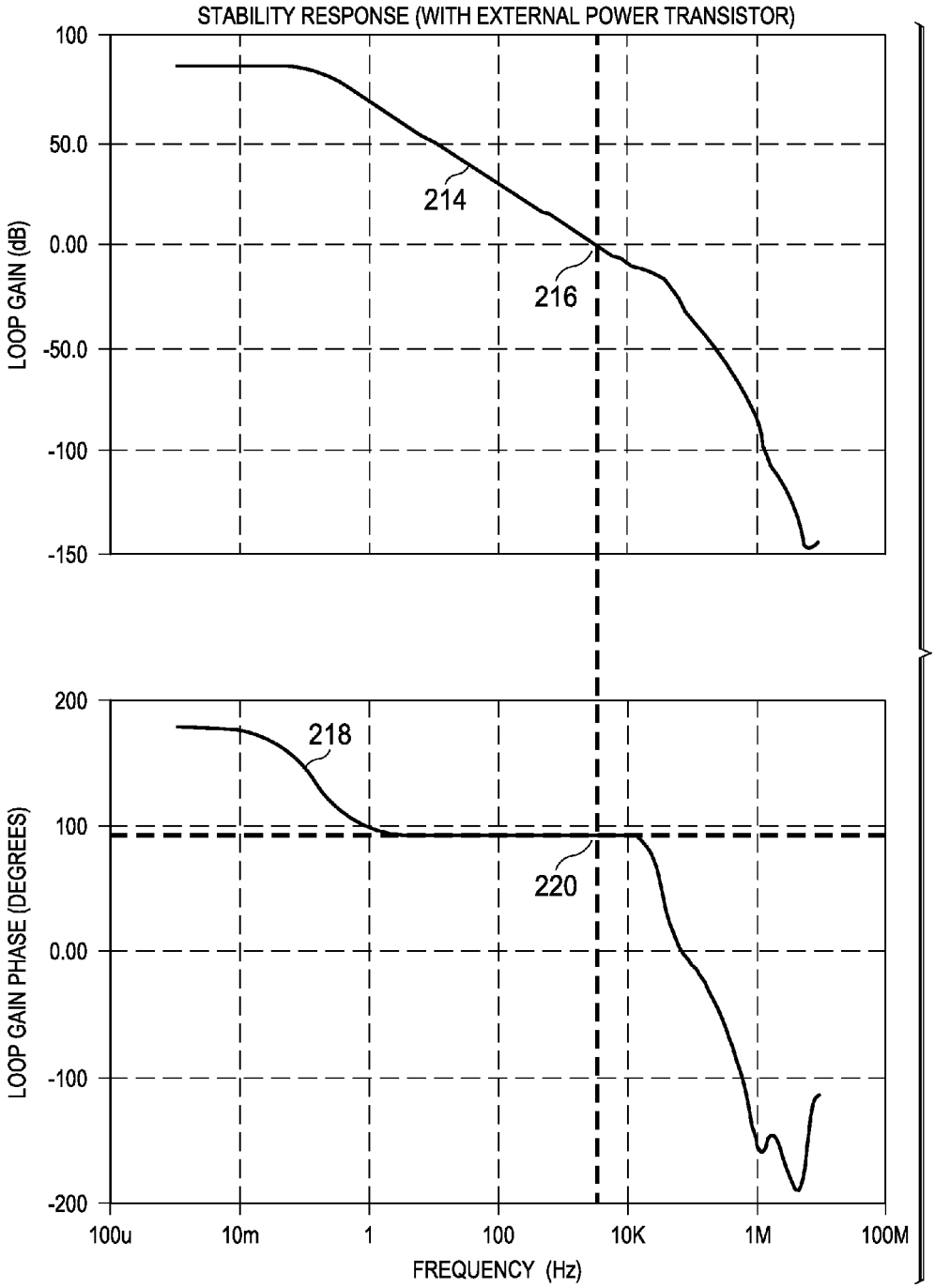
FIG. 9 includes example graphs illustrating a stability response of the voltage regulator in the configuration shown in FIG. 4, according to an embodiment of the present invention.

FIG. 8 shows a transient step response and FIG. 9 shows a Bode plot for a simulated operation of an example implementation of the voltage regulator IC 144 (FIG. 5) in the configuration with the external power transistor 152 (FIG. 4). A test load current with a load step from about 50 mA to about 75 mA, about a 50% increase, and back with a one microsecond rise/fall time (upper graph 210 of FIG. 8) is used to exercise the circuitry in the simulation. The output voltage response (lower graph 212 of FIG. 8) shows that at about the 50 mA load and at about the 75 mA load the output voltage is about 3.30 Volts. At the transitions, the output voltage transient step response exhibits minor ringing, with plus or minus 70-75 millivolts of overshoot or undershoot, before quickly settling. The load regulation is very good primarily because the current through the compensation resistor 174 is negligible in this case.

A loop gain graph 214 (upper portion of FIG. 9) for the simulation shows that unity gain (at point 216) for the voltage regulator IC 144 in this example occurs at a frequency of about 3.5 KHz (vertical dashed line). A loop gain phase graph 218 (lower portion of FIG. 9) for the simulation shows that the frequency of about 3.5 KHz (unity gain) corresponds (at point 220) with a phase margin of about 90.6 degrees (horizontal dashed line) for the example voltage regulator 144.

The phase margin of about 90.6 degrees is well within the desired limitation of being more than 45 degrees. In fact, an almost 90 degree phase margin indicates almost a "one pole" system, which is considered highly stable. This result generally agrees with the output voltage transient step response, which is shown to settle to a steady state relatively smoothly.

Presently preferred embodiments of the present invention and its improvements have been described with a degree of particularity. This description has been made by way of preferred example. It should be understood, however, that the scope of the claimed subject matter is defined by the following claims, and should not be unnecessarily limited by the detailed description of the preferred embodiments set forth above.

The invention claimed is:

1. A voltage regulator comprising:

a sensor that determines whether an external power transistor is connected to the voltage regulator;

a frequency compensation circuitry comprising a capacitor and that contributes to frequency compensation within the voltage regulator when it is determined that the external power transistor is connected to the voltage regulator and that does not contribute to frequency compensation within the voltage regulator when it is determined that the external power transistor is not connected to the voltage regulator; and a switch operated by the sensor to prevent the capacitor from contributing to the frequency compensation when it is determined that the external power transistor is not connected to the voltage regulator and to enable the capacitor to contribute to the frequency compensation when it is determined that the external power transistor is connected to the voltage regulator.

2. The voltage regulator of claim 1, further comprising:

first and second I/O nodes; and wherein:

a determination that the external power transistor is not connected to the voltage regulator indicates that the first and second I/O nodes are shorted together; and a determination that the external power transistor is connected to the voltage regulator indicates that the external power transistor is connected between the first and second I/O nodes.

3. The voltage regulator of claim 2, wherein:

a determination that the external power transistor is connected to the voltage regulator further indicates that a resistor is also connected between the first and second I/O nodes.

4. The voltage regulator of claim 1, further comprising:

the external power transistor.

5. The voltage regulator of claim 1, wherein:

the voltage regulator can operate in a first configuration in which the external power transistor is not connected to the voltage regulator and in a second configuration in which the external power transistor is connected to the voltage regulator;

in the first configuration, the voltage regulator implements a first frequency compensation scheme that does not use the capacitor; and in the second configuration, the voltage regulator implements a second frequency compensation scheme that uses the capacitor.

6. The voltage regulator of claim 1, further comprising: an internal power transistor that is regulated to generate an output voltage in a first configuration in which the external power transistor is not connected to the voltage regulator and that is regulated to control the external power transistor in a second configuration in which the external power transistor is connected to the voltage regulator.

7. The voltage regulator of claim 6, wherein:

in the first configuration, the output voltage is at a first output current level; and in the second configuration, the internal power transistor controls the external power transistor to generate the output voltage at a second output current level.

8. The voltage regulator of claim 1, further comprising: an integrated circuit that includes the sensor, the capacitor and the switch; and wherein:

in a first configuration in which the external power transistor is not connected to the integrated circuit, the integrated circuit functions to produce an output voltage; and in a second configuration in which the external power transistor is connected to the integrated circuit, the integrated circuit functions to control the external power transistor to produce the output voltage.

9. The voltage regulator of claim 8, wherein:

the integrated circuit further includes first, second and third I/O nodes;

at the first I/O node, in both the first and second configurations, the integrated circuit receives a supply voltage;

at the second I/O node, in the first configuration, the integrated circuit receives the supply voltage;

at the second I/O node, in the second configuration, the integrated circuit is connected to control the external power transistor;

at the third I/O node, in the first configuration, the integrated circuit produces the output voltage; and at the third I/O node, in the second configuration, the integrated circuit receives feedback of the output voltage.

10. A voltage regulator comprising:

an internal power transistor;

an integrated circuit that contains internal components of the voltage regulator, the integrated circuit functions in a first configuration to produce an output voltage of the voltage regulator at a first desired output current level using the internal power transistor and a first frequency compensation scheme and functions in a second configuration to control an external power transistor to produce the output voltage of the voltage regulator at a second desired output current level with a second frequency compensation scheme;

a first I/O node of the integrated circuit at which the integrated circuit receives a supply voltage in both the first and second configurations;

a second I/O node of the integrated circuit at which the integrated circuit receives the supply voltage in the first configuration and which is connected to control the external power transistor in the second configuration;

a third I/O node of the integrated circuit at which the integrated circuit produces the output voltage in the first configuration and at which the integrated circuit receives feedback of the output voltage in the second configuration;

an internal sensor that determines whether the integrated circuit is in either the first configuration in which the external power transistor is not connected to the integrated circuit or the second configuration in which the external power transistor is connected to the integrated circuit by determining whether a voltage at the second I/O node is substantially less than a sense voltage based on the supply voltage from the first I/O node;

an internal capacitor that contributes to the second frequency compensation scheme within the voltage regulator when it is determined in the second configuration that the external power transistor is connected to the integrated circuit; and an internal switch, activated and deactivated by the internal sensor, that prevents the capacitor from contributing to the first frequency compensation scheme when it is determined in the first configuration that the external power transistor is not connected to the integrated circuit and that enables the capacitor to contribute to the second frequency compensation scheme when it is determined in the second configuration that the external power transistor is connected to the integrated circuit.

11. The voltage regulator of claim 10, further comprising:

the external power transistor.

12. A method of operating a voltage regulator comprising:

powering on the voltage regulator that includes an internal capacitor;

determining whether an external power transistor is connected to the voltage regulator;

upon determining that the external power transistor is not connected to the voltage regulator, utilizing a first frequency compensation scheme by the voltage regulator that includes preventing the internal capacitor from contributing to frequency compensation by the voltage regulator; and upon determining that the external power transistor is connected to the voltage regulator, utilizing a second frequency compensation scheme by the voltage regulator that includes enabling the internal capacitor to contribute to the frequency compensation by the voltage regulator.

13. The method of claim 12, wherein:

a determination that the external power transistor is not connected to the voltage regulator indicates that first and second I/O nodes of the voltage regulator are shorted together; and a determination that the external power transistor is connected to the voltage regulator indicates that the external power transistor is connected between the first and second I/O nodes.

14. The method of claim 13, wherein:

a determination that the external power transistor is connected to the voltage regulator further indicates that a resistor is also connected between the first and second I/O nodes.

15. The method of claim 12, further comprising:

upon determining that the external power transistor is not connected to the voltage regulator, regulating an internal power transistor to generate an output voltage with a first output current level; and upon determining that the external power transistor is connected to the voltage regulator, regulating the internal power transistor to control the external power transistor to generate the output voltage with a second output current level.

16. The method of claim 12, wherein:

the enabling of the internal capacitor to contribute to the frequency compensation by the voltage regulator further comprises turning on a switch to cause the internal capacitor to be in a regulation feedback loop of the voltage regulator.

17. The method of claim 12, wherein:

the powering on of the voltage regulator further comprises providing a supply voltage to the voltage regulator; and the determining of whether the external power transistor is connected to the voltage regulator further comprises sensing whether a voltage at an I/O node is substantially less than the supply voltage.

18. The method of claim 12, further comprising:

in a first configuration, in which the external power transistor is not connected to an integrated circuit of the voltage regulator that includes the capacitor and first, second and third I/O nodes, the integrated circuit a) receiving a supply voltage at the first and second I/O nodes and b) producing an output voltage at the third I/O node; and in a second configuration, in which the external power transistor is connected to the integrated circuit, the integrated circuit a) receiving the supply voltage at the first I/O node, b) producing a control signal at the second I/O node to cause the external power transistor to produce the output voltage and c) receiving a feedback of the output voltage at the third I/O node.

* * * * *